US009657939B2

(12) United States Patent
Jastrzebski et al.

(10) Patent No.: US 9,657,939 B2
(45) Date of Patent: May 23, 2017

(54) FLUIDIC CONTROL BURNER FOR PULVEROUS FEED

(71) Applicant: Hatch Ltd., Mississauga (CA)

(72) Inventors: Maciej Jastrzebski, Oakville (CA); Alan Mallory, Barrie (CA); Javier Eduardo Larrondo Piña, Providencia (CL); Thomas W. Gonzales, Tucson, AZ (US); Alexandre Lamoureux, Montréal (CA); Ivan Marincic, Mississauga (CA)

(73) Assignee: Hatch Ltd., Mississauga, Ontario (CA)

( * ) Notice: Subject to any disclaimer, the term of this patent is extended or adjusted under 35 U.S.C. 154(b) by 114 days.

(21) Appl. No.: 14/390,944

(22) PCT Filed: Apr. 5, 2013

(86) PCT No.: PCT/CA2013/000327
§ 371 (c)(1),
(2) Date: Oct. 6, 2014

(87) PCT Pub. No.: WO2013/149332
PCT Pub. Date: Oct. 10, 2013

(65) Prior Publication Data

US 2015/0061201 A1 Mar. 5, 2015

Related U.S. Application Data

(60) Provisional application No. 61/620,799, filed on Apr. 5, 2012.

(51) Int. Cl.

| | |
|---|---|
| ***F23D 1/00*** | (2006.01) |
| ***F27D 99/00*** | (2010.01) |
| ***F27D 3/00*** | (2006.01) |

(52) U.S. Cl.
CPC ..... *F23D 1/00* (2013.01); *F27D 3/0033* (2013.01); *F27D 99/0033* (2013.01)

(58) Field of Classification Search
CPC ..... F23D 1/00; F27D 3/0033; F27D 99/0033
(Continued)

(56) References Cited

U.S. PATENT DOCUMENTS 4,848,754 A * 7/1989 Kemori ..... C22B 5/14 266/162
6,238,457 B1 5/2001 Holmi et al.
(Continued)

FOREIGN PATENT DOCUMENTS

WO 2011/048263 4/2011
WO WO 2011048263 * 4/2011 ..... C22B 15/00

OTHER PUBLICATIONS

International Search Report of International Patent Application No. PCT/CA2013/000327.

*Primary Examiner* — Scott Kastler
*Assistant Examiner* — Michael Aboagye
(74) *Attorney, Agent, or Firm* — Bereskin & Parr LLP

(57) ABSTRACT

A burner is provided for a pulverous feed material. The burner has a structure that integrates the burner with a reaction vessel, and has an opening that communicates with the interior of the reaction vessel. The burner also has a gas supply channel to supply reaction gas through the opening into the reaction vessel, and a feed supply for delivering pulverous material to the reaction vessel. The burner also has a fluidic control system having at least one port capable of directing a stream of fluid at an angle to the direction of flow of the reaction gas so as to modify the flow of the reaction gas. In addition, components are provided to modify the swirl intensity and turbulence intensity of the reaction gas independently of the exit velocity.

19 Claims, 7 Drawing Sheets

(58) Field of Classification Search
USPC ..... 266/100, 200, 221, 225, 241, 267; 75/455, 454, 707
See application file for complete search history.

(56) References Cited

U.S. PATENT DOCUMENTS

| | | | | |
|---|---|---|---|---|
| 6,474,569 | B1 * | 11/2002 | Brundish | F15C 1/08 239/404 |
| 2010/0207307 | A1 * | 8/2010 | Sipila | C22B 15/0047 266/175 |
| 2011/0074070 | A1 | 3/2011 | Yasuda et al. | |
| 2012/0280437 | A1 | 11/2012 | Gonzalez et al. | |

* cited by examiner

FLUIDIC CONTROL BURNER FOR PULVEROUS FEED

TECHNICAL FIELD

The present subject matter relates to burners for use with pulverous feed materials, such as burners used, for example, on flash smelting furnaces.

BACKGROUND

Flash smelting is a pyrometallurgical process in which a finely ground feed material is combusted with a reaction gas. A flash smelting furnace typically includes an elevated reaction shaft at the top of which is positioned a burner where pulverous feed material and reaction gas are brought together. In the case of copper smelting, the feed material is typically ore concentrates containing both copper and iron sulfide minerals. The concentrates are usually mixed with a silica flux and combusted with pre-heated air or oxygen-enriched air. Molten droplets are formed in the reaction shaft and fall to the hearth, forming a copper-rich matte and an iron-rich slag layer. Much of the sulfur in the concentrates combines with oxygen to produce sulfur dioxide which can be exhausted from the furnace as a gas and further treated to produce sulfuric acid.

A conventional burner for a flash smelter includes an injector having a water-cooled sleeve and an internal central lance, a wind box, and a cooling block that integrates with the roof of the furnace reaction shaft. The lower portion of the injector sleeve and the inner edge of the cooling block create an annular channel. The feed material is introduced from above and descends through the injector sleeve into the reaction shaft. Oxygen enriched combustion air enters the wind box and is discharged to the reaction shaft through the annular channel. Deflection of the feed material into the reaction gas is promoted by a bell-shaped tip at the lower end of the central lance. In addition, the tip includes multiple perforation jets that direct compressed air outwardly to disperse the feed material in an umbrella-shaped reaction zone. A contoured adjustment ring is mounted around the lower portion of the injector sleeve within the annular channel, and can slide along the vertical axis. The velocity of the reaction gas can be controlled to respond to different flow rates by raising and lowering the adjustment ring with control rods that extend upwardly through the wind box to increase or reduce the cross-sectional flow area in the annular channel. Such a burner for a flash smelting furnace is disclosed in U.S. Pat. No. 6,238,457.

Known burners of this type are associated with disadvantages that can adversely affect their performance. These include failure to achieve maximal mixing of the feed material with the combustion gas to optimize oxygen efficiency within the reactor. In addition, such burners have limited range of velocity control to optimize the performance of the burner relative to the feed material.

For example, the adjustment ring has a tendency to become sticky or misaligned on the injector sleeve. In addition, the adjustment ring is prone to accretions, which lead to obstructions in the combustion gas flow path. Both of these problems are known to lead to poor mixing and skewing of the burner flame, which causes poor combustion.

The presence of the adjustment ring precludes the possibility of mounting additional devices which can further adjustably modify the gas flow characteristics independently of velocity. Devices such as adjustable swirl inducing components, turbulence generating components, shrouds, etc.

cannot be incorporated into a conventional design. These devices are known from other combustion fields, and are known to improve mixing and plume characteristics, improving combustion.

It is a goal of the inventors to provide an improved burner for a flash smelting furnace or other applications using a pulverous feed material that provides better mixing, more optimal oxygen efficiency, improved control, and ease of maintenance.

SUMMARY OF THE DISCLOSURE

The following summary is intended to introduce the reader to the more detailed description that follows, and not to define or limit the claimed subject matter.

According to one aspect, a burner is provided for a pulverous feed material. The burner has a structure that integrates the burner with a reaction vessel, and has an opening that communicates with the interior of the reaction vessel. The burner also has a gas supply channel to supply reaction gas through the opening into the reaction vessel, and a feed supply for delivering pulverous material to the reaction vessel. The burner also has a fluidic control system having at least one port capable of directing a stream of fluid at an angle to the direction of flow of the reaction gas so as to modify the flow of the reaction gas.

In some examples, the burner is provided for a flash smelting furnace, and it integrates with the roof of the furnace. The burner may have a nozzle that defines an opening that communicates with the reaction shaft of the furnace. The burner may also include a gas supply channel to supply reaction gas to the reaction shaft through the nozzle, and an injector having a sleeve for delivering the pulverous feed material to the furnace, the injector extending through the nozzle, defining therewith an annular channel through which the reaction gas flows into the reaction shaft.

According to another aspect, a burner is provided for a flash smelting furnace. The burner includes a burner block, a nozzle, a wind box, an injector, and a fluidic control system. The block integrates with the roof of the furnace, and has an opening therethrough to communicate with the reaction shaft of the furnace. The wind box is mounted over the block and supplies reaction gas to the reaction shaft through the nozzle which extends through the block opening. The injector has a sleeve for delivering pulverous feed material to the furnace and a central lance within the sleeve to supply compressed air for dispersing the pulverous feed material in the reaction shaft. The injector is mounted within the wind box so as to extend through the nozzle, defining therewith an annular channel through which reaction gas from the wind box flows into the reaction shaft. The fluidic control system can be used to modify the velocity, direction, swirl, turbulence and/or other characteristics of the flow of the reaction gas and has at least one port capable of directing a stream of a fluid at an angle to the direction of flow of the reaction gas.

In some examples, the at least one port is connected to at least one conduit that carries the stream of fluid remote from at least one port. The at least one port may be able to expel the stream of fluid into the reaction gas. The at least one port may also be able to draw the stream of fluid out of the reaction gas.

In some examples, the burner includes at least one valve to adjust the stream of fluid. The burner may also include an actuator to govern the at least one valve.

The burner may include a plurality of ports. In some examples, the burner includes at least one port located on the sleeve. The conduits may pass within the wall of the sleeve. In some examples, the burner may include at least one port located on the nozzle.

In some examples, the burner includes at least one port located within the wind box, above the annular channel, mounted on the water cooled sleeve. In some examples, the burner includes at least one port located within the wind box, above the annular channel, mounted in or as part of the wind box.

In some examples, the stream of fluid is used to manipulate the boundary layer within the annular channel to alter the velocity of the flow of the reaction gas. The stream of fluid can also be used to induce increased swirling of the flow of the reaction gas. The stream of fluid can also be used to induce increased turbulence of the flow of the reaction gas.

In some examples, the burner includes a nozzle with an internal, pressurized cavity containing a port in the form of a continuous slit around the full nozzle circumference to provide uniform flow of fluid around the entire nozzle, resulting in uniform annular flow of the reaction gas exiting the nozzle.

In some examples, the burner includes a plurality of valves to adjust the plurality of ports individually. In other examples, the burner includes a plurality of valves to adjust the plurality of ports in groups. In some examples, the valve controller is programmable.

In some examples, the ports include holes. In some examples, the ports include slits. In some examples, the cross-sectional area of the ports can be adjusted. In some examples, the direction of the ports can be adjusted. In some examples, the velocity of the stream of fluid can be adjusted. In some examples, the stream of fluid can be pulsed. In some examples, the stream of fluid is generated intermittently as pulses through the use of a piezoelectric pump, or a vibrating diaphragm.

In some examples, the stream of fluid includes air, oxygen, nitrogen, or oxygen enriched air. In some examples, the stream of fluid includes redirected reaction gas.

In some examples, an insert ring containing curved vanes that surround the sleeve can be inserted into the nozzle flow area to decouple swirling flow control from the fluidic control fluid stream. The swirl inducing component can be moved in the vertical direction to control the amount of swirl imparted to the reaction gas.

In some examples, an insert ring containing a series of angled plates, helical vanes, or other flow conditioning profiles inserted into the nozzle flow area to decouple turbulence intensity control from the fluidic control fluid stream. The turbulence generating component insert can be moved in the vertical direction to control the swirl intensity of the reaction gas.

According to another aspect, a method is provided for regulating the flow of reaction gas in a burner for pulverous feed material. The method includes directing a stream of fluid at an angle to the direction of flow of the reaction gas. In some examples, the stream of fluid is directed through at least one port in the burner.

BRIEF DESCRIPTION OF THE DRAWINGS

In order that the claimed subject matter may be more fully understood, reference will be made to the accompanying drawings, in which:

DETAILED DESCRIPTION OF EMBODIMENTS

In the following description, specific details are set out to provide examples of the claimed subject matter. However, the embodiments described below are not intended to define or limit the claimed subject matter. It will be apparent to those skilled in the art that many variations of the specific embodiments may be possible within the scope of the claimed subject matter.

Figure 1:
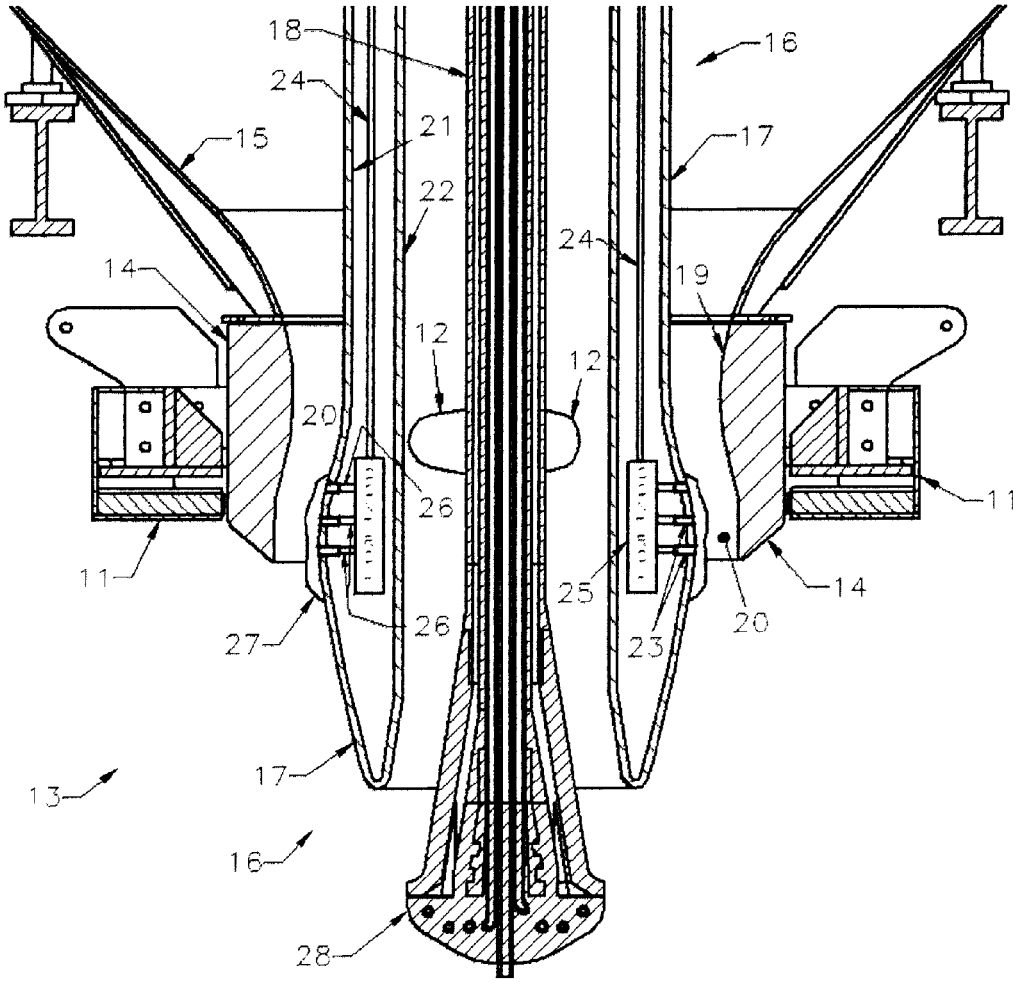
FIG. 1 is a cross-sectional view of a burner for a flash smelting furnace according to one embodiment.

As shown in FIG. 1, a burner 13 is positioned above the reaction shaft of a flash smelting furnace. The base of the burner 13 is provided by a block 11 which integrates into the roof of the reaction shaft of the furnace and a nozzle 14 which extends through the block 11. A wind box 15 is mounted above the nozzle 14 and an injector 16 having a sleeve 17 and a central lance 18 extends through the wind box 15 and through an opening 19 in the nozzle 14. Above the wind box 15 is the material feed equipment, comprising air slides, splitter boxes, manifold connectors, feed pipes, and a distributor which communicates with the sleeve 17 of the injector 16. The central lance 18 of the injector 16 extends upwardly beyond the sleeve 17 through the top of the distributor to a lance head section. Radiating guide wings 12 help to keep the central lance 18 centered within the sleeve 17. The sleeve 17 may also have similarly radiating vanes (not shown) to help to keep the sleeve 17 centered within the opening 19 of the nozzle 14.

The burner is mounted on the furnace support structure and the nozzle 14 extends through the burner block 11 which provides the main seal between the reaction shaft of the furnace and the burner 13. The block 11 is water-cooled and has multiple ports for access and cleaning of the burner components that are located below the block 11. The injector sleeve 17 extends down into the upper portion of the reaction shaft of the furnace. The central lance 18 has a tip 28 at its lower end which extends below the sleeve 17. The lower, inside rim of the sleeve 17 diverges towards the bottom opening and the lance tip 28 has a frustoconical shape and together they direct the feed material outwardly. The lance 18 carries compressed air which is directed horizontally from the tip 28. The compressed air further disperses the feed material in an umbrella pattern through the reaction shaft of the furnace. The opening 19 of the nozzle 14 and the sleeve 17 define an annular channel 20 through which the reaction gas passes from the wind box 15 to the reaction shaft.

The sleeve 17 includes an outer wall 21 and an inner wall 22. Water cooling means (not shown) may be accommodated between the outer wall and the inner wall 21, 22.

Also accommodated between the outer and inner walls 21, 22 of the sleeve 17 are fluid supplied conduits 24 which can supply a regulating fluid from a source exterior to the sleeve (not shown) to a manifold 25 located within the sleeve 17. The manifold includes a plurality of radiating tubes 26 positioned around the circumference of the sleeve at multiple levels. The tubes 26 define ports 23 on the outer wall 21 of the sleeve 17, the ports 23 being aligned generally with the lower region of the annular channel through which the reaction gas flows into the furnace. The fluid is supplied from the enriched air ducts and is directed through a compressor which increases the pressure to the required level. Multiple actuated valves (not shown) mounted externally to the burner are governed by a PLC (programmable logic control) to adjust the stream of fluid through the ports 23 of the tubes 26 so as to impinge upon the reaction gas approximately perpendicular to the direction of flow of the reaction gas. Feedback is provided to the PLC by pressure sensors mounted within the conduits 24. Adjusting the stream of fluid in this matter can be used to manipulate the boundary layer 27 of the reaction gas flow along the outer wall 21 of the sleeve 17 so as to restrict the flow and decrease the cross-sectional exit area of the reaction gas flow, thereby increasing the exit velocity.

If the conduits 24 communicate with a source of reduced pressure, a partial vacuum can be created in the manifold so as to decrease the boundary layer 27 along the outer wall 21 of the sleeve 17, thereby decreasing the exit velocity of the reaction gas.

Figure 2:
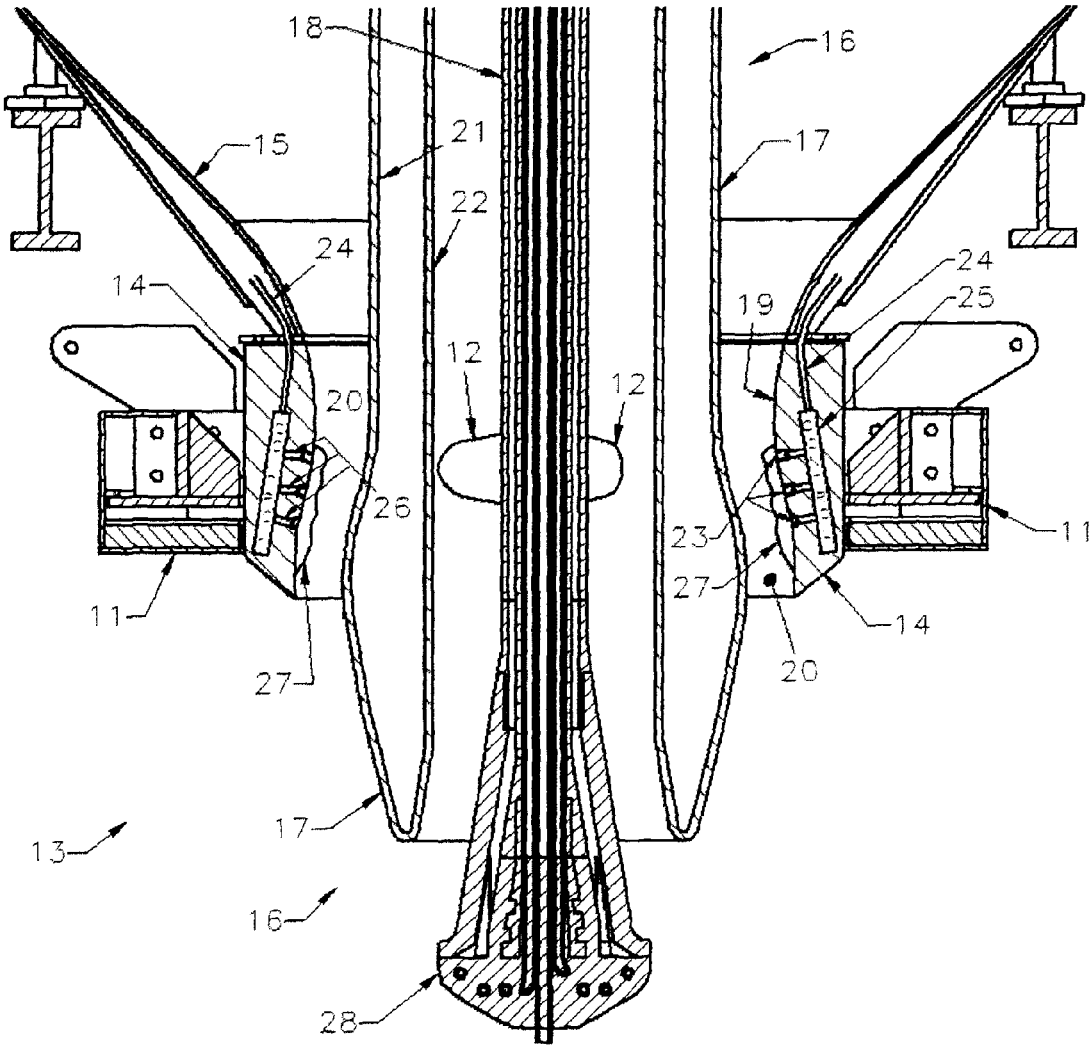
FIG. 2 is a cross-sectional view of a burner for a flash smelting furnace according to a second embodiment.

Turning to FIG. 2, a second embodiment is shown. Similar components are given like names and like reference numbers, and their description will not be repeated.

In this embodiment, the stream of fluid is supplied through a manifold 25 located inside the nozzle 14 and is used to manipulate the boundary layer 27 along the interior wall of the nozzle 14 defining the opening 19.

Figure 3:
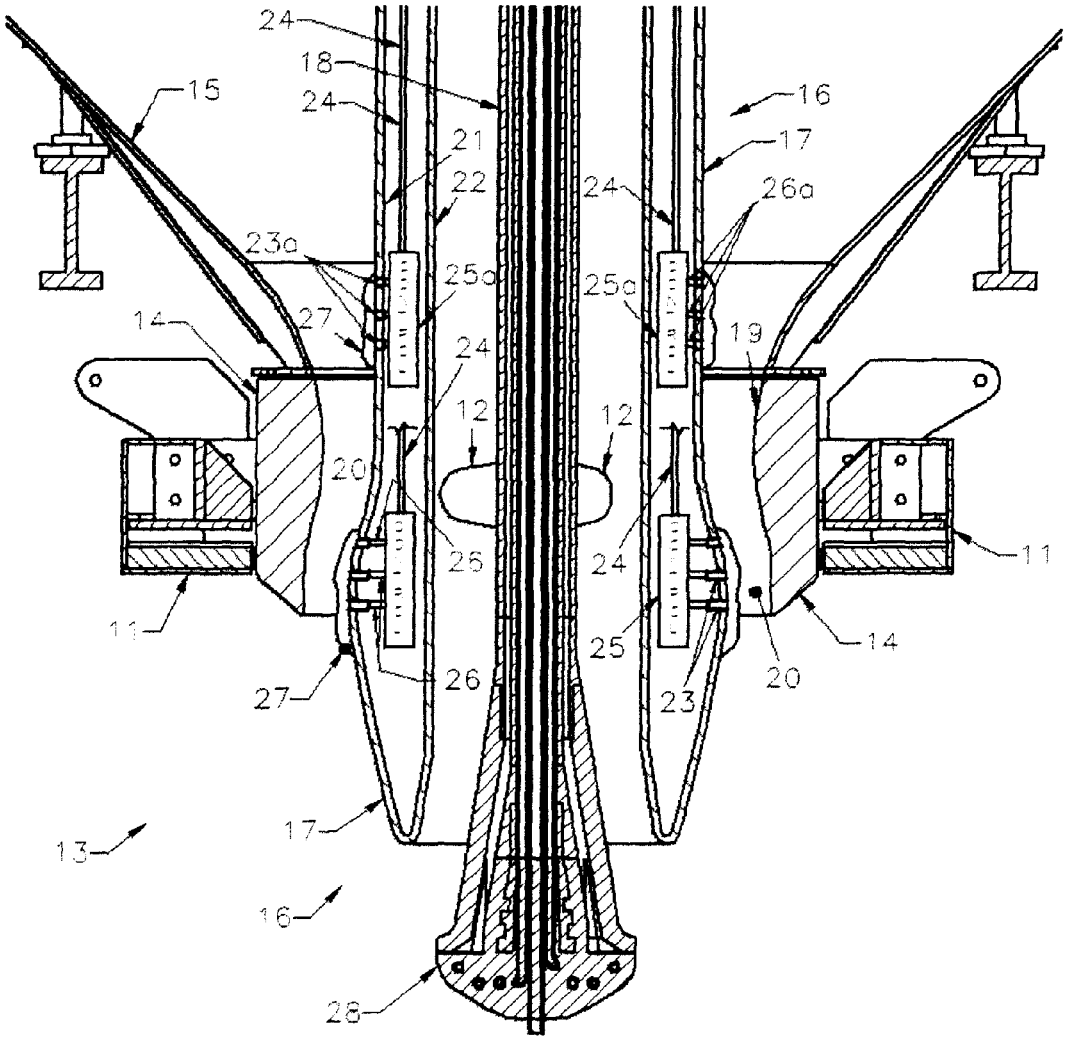
FIG. 3 is a cross-sectional view of a burner for a flash smelting furnace according to a third embodiment.

Turning to FIG. 3, a further embodiment is shown. Similar components are given like names and like reference numbers, and their description will not be repeated.

In this embodiment, the conduits 24 communicate with a secondary manifold 25*a* from which radiate tubes 26*a* that terminate in ports 23*a* located in the wind box 15, above the annular channel 20 defined by the sleeve 17 and the opening 19 of the nozzle 14. The tubes 26*a* of the secondary manifold 25*a* are disposed tangentially and at an angle to the circumference of the sleeve such that streams of fluid expelled through the ports 23*a* of the secondary manifold 25*a* can be used to modify the direction, swirl, turbulence or other characteristics of the flow of the reaction gas.

Figure 4:
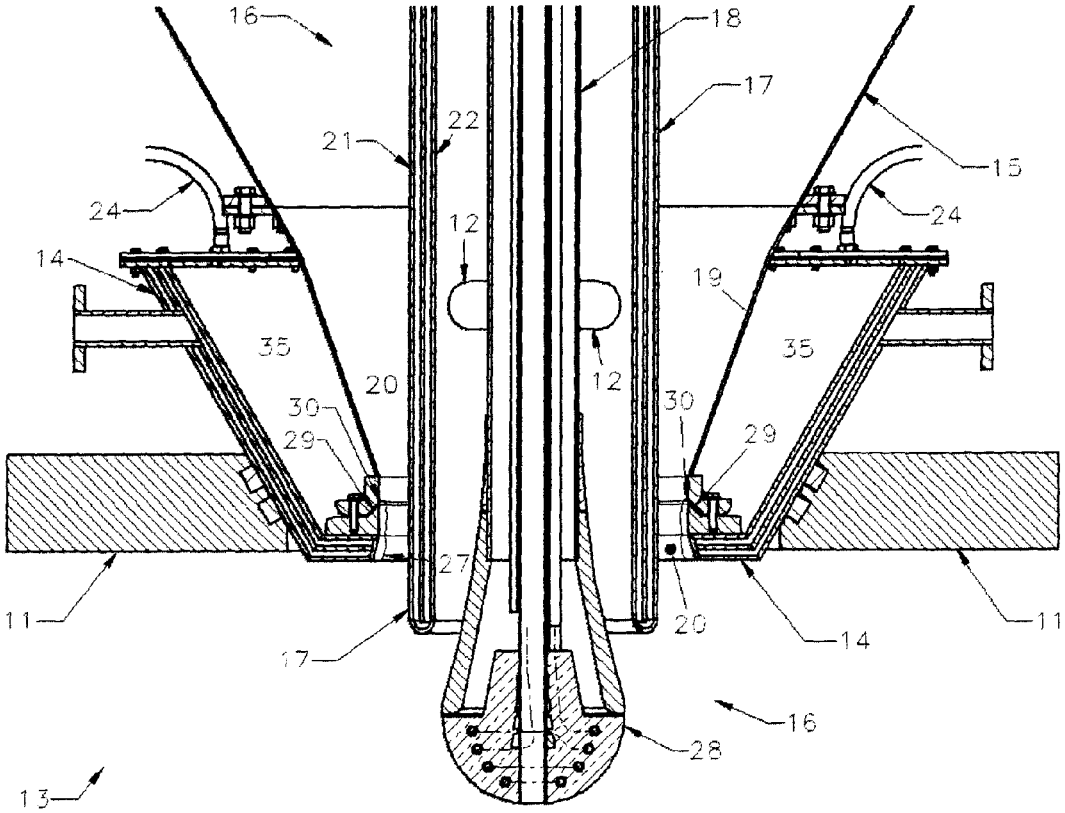
FIG. 4 is a cross-sectional view of a burner for a flash smelting furnace according to a fourth embodiment.

Turning to FIG. 4, a further embodiment is shown. Similar components are given like names and like reference numbers, and their description will not be repeated.

In this embodiment, the interior of the water-cooled nozzle 14 forms a pressurized plenum 35, which is supplied with a stream of fluid through one or more conduits 24 located around the nozzle 14. The pressurized plenum 35 is continuous around the full circumference of the nozzle 14. The fluid exits the pressurized plenum 35 through annular slit 29 located around the inside, bottom of the nozzle 14, and enters around the interior wall of the nozzle 14 through an annular slit opening 30 at an angle of 45° opposite to the direction of reaction gas flow. The injected fluid controls the boundary layer 27 along the interior wall of the nozzle 14 defining the opening 19.

Figure 9:
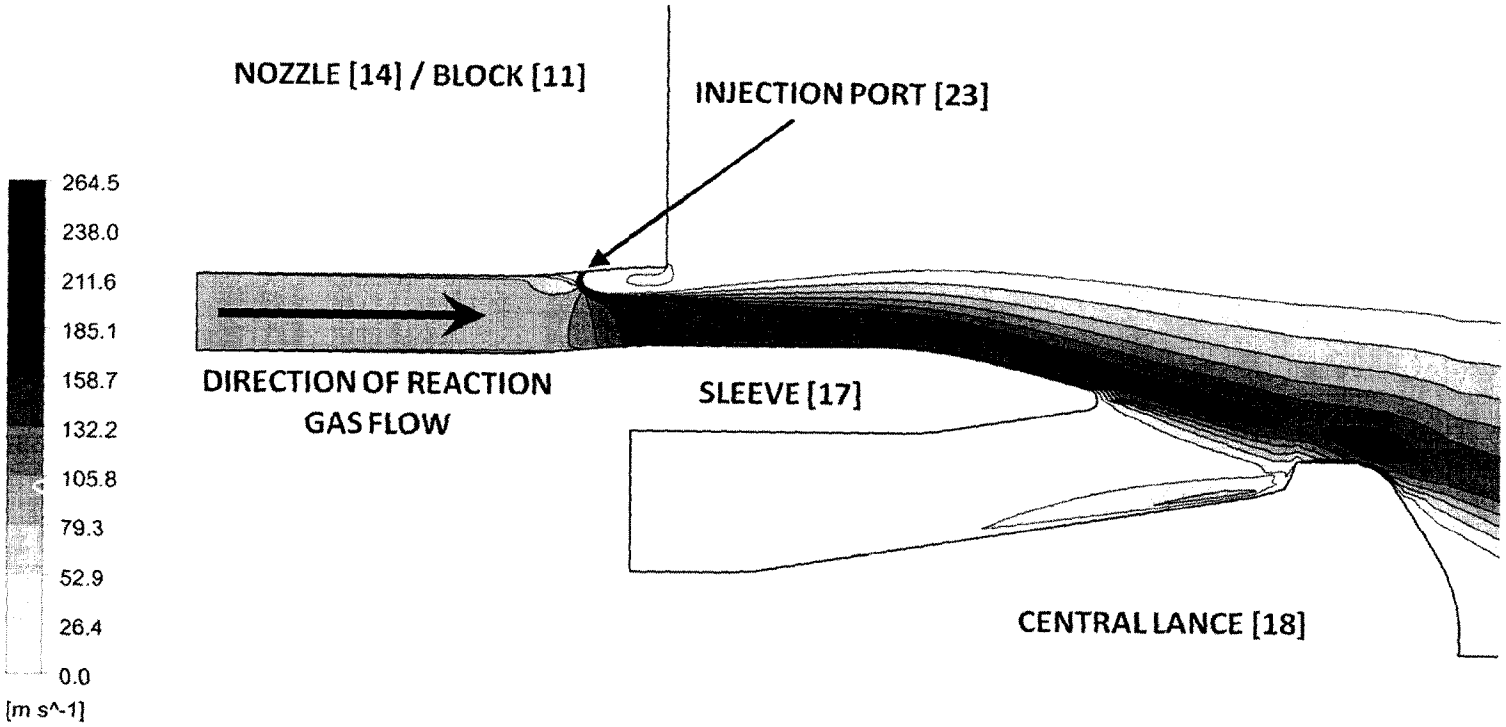
FIG. 9 is a contour plot of fluid velocity showing the effect of fluidic control in the embodiment of FIG. 4.

This embodiment has been analyzed using Computational Fluid Dynamics (CFD) which has shown that a substantial increase in velocity can be achieved by diverting a fraction of the reaction gas into the pressurized plenum. An image showing the effect of fluidic control on the main reaction gas jet can be seen in FIG. 9, which contains a contour plot of the fluid velocity [m/s]. The results obtained from the analysis are shown in Table 1. Depending on the flow rate in the CFD model, a velocity increase of approximately 50% was seen for injections of 10% of the reaction gas flow rate through the port.

This embodiment ensures a continuous fluid injection area and hence creates a uniform boundary layer 27 around the full nozzle 14 circumference, ensuring a uniform jet velocity profile of the reaction gas exiting the annular channel 20 defined by the opening 19 of the nozzle 14 and the sleeve 17.

TABLE 1

| FLOW RATE [$Nm^3/hr$] | Injection Ratio [% of Flow Rate] | $M_{injection}$ | $V_1$ [m/s] | $V_2$ [m/s] | Increase in Velocity |
|---|---|---|---|---|---|
| 30000 | 0 | N/A | 62.17 | 62.5 | N/A |
| 30000 | 5 | 0.206 | 61.94 | 78.15 | 25.0% |
| 30000 | 10 | 0.4067 | 61.37 | 94.29 | 50.9% |
| 50000 | 0 | N/A | 102.48 | 102.99 | N/A |
| 50000 | 5 | 0.3382 | 101.51 | 127.23 | 23.5% |
| 50000 | 10 | 0.6611 | 99.38 | 150.66 | 46.3% |

Where:

$M_{injection}$: Mach # of the fluid leaving the port.

$V_1$: Area weighted average velocity; representative of average nozzle velocity before injection.

$V_2$: Mass-flow weighted average velocity; representative of average nozzle velocity after injection.

Figure 5:
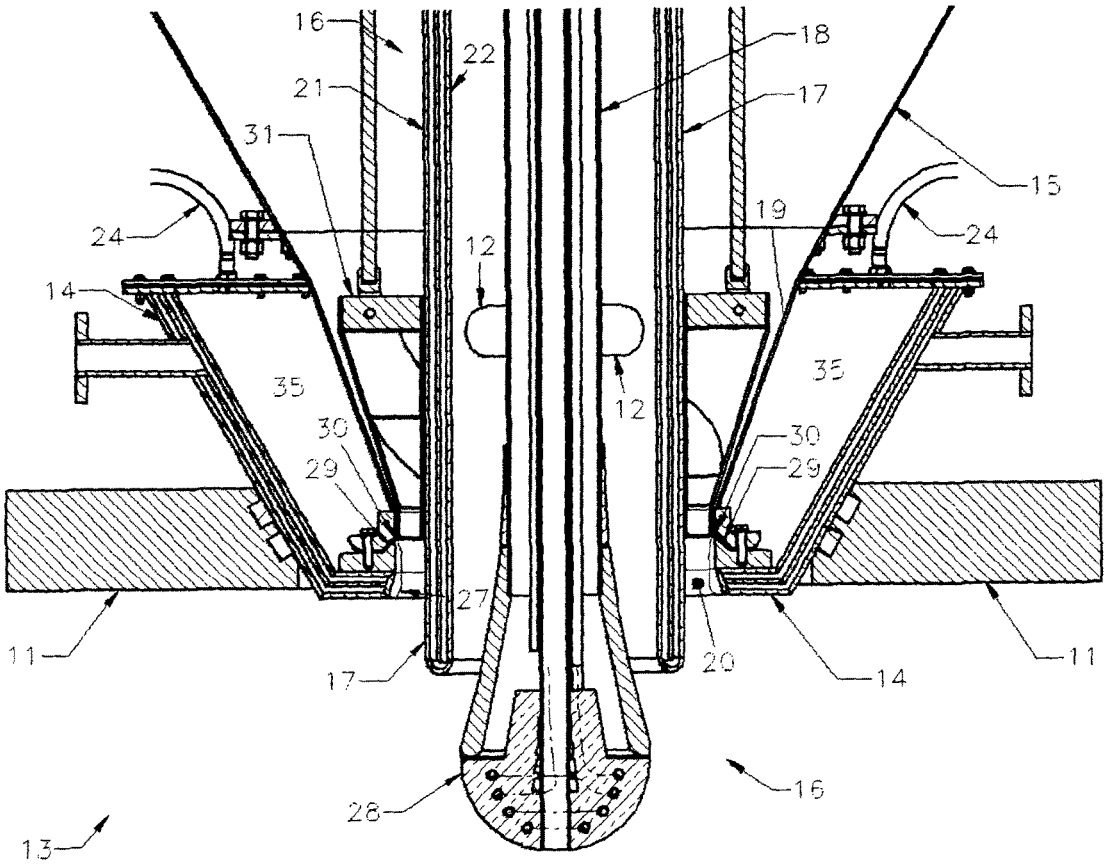
FIG. 5 is a cross-sectional view of a burner for a flash smelting furnace according to a fifth embodiment.

Turning to FIG. 5, a further embodiment is shown. Similar components are given like names and like reference numbers, and their description will not be repeated.

Figure 6:
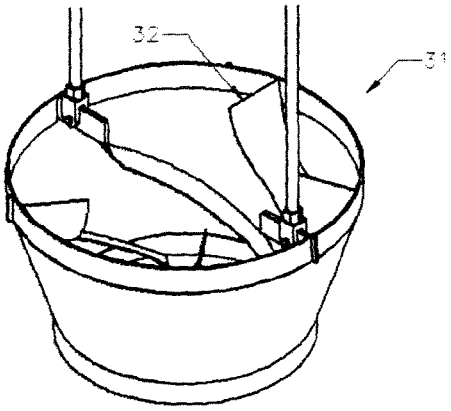
FIG. 6 is an isometric view of a swirl inducing component to be used with the burner embodiment of FIG. 5.

In this embodiment, a swirl inducing component 31 resides in the annular channel 20 defined by the opening 19 of the nozzle 14 and the sleeve 17, and manipulates the passing fluid velocity profile. The swirl inducing component 31, as shown in FIG. 6, contains a plurality of vanes 32, which impart a tangential velocity to the passing fluid, thereby inducing an overall swirling motion of the fluid flowing into the reaction shaft.

The vertical position of the swirl inducing component 31 is controlled to manipulate the amount of swirl induced in the reaction gas, controlling the overall burner plume shape as well as the mixing characteristics within the reaction shaft.

The vertical position of the swirl inducing component 31 controls the degree of swirling independently of the axial velocity of the fluid, which is controlled by the pressurized plenum 35.

Controlling the plume shape also allows control of the temperature and wear of the reaction shaft refractory lining.

Figure 7:
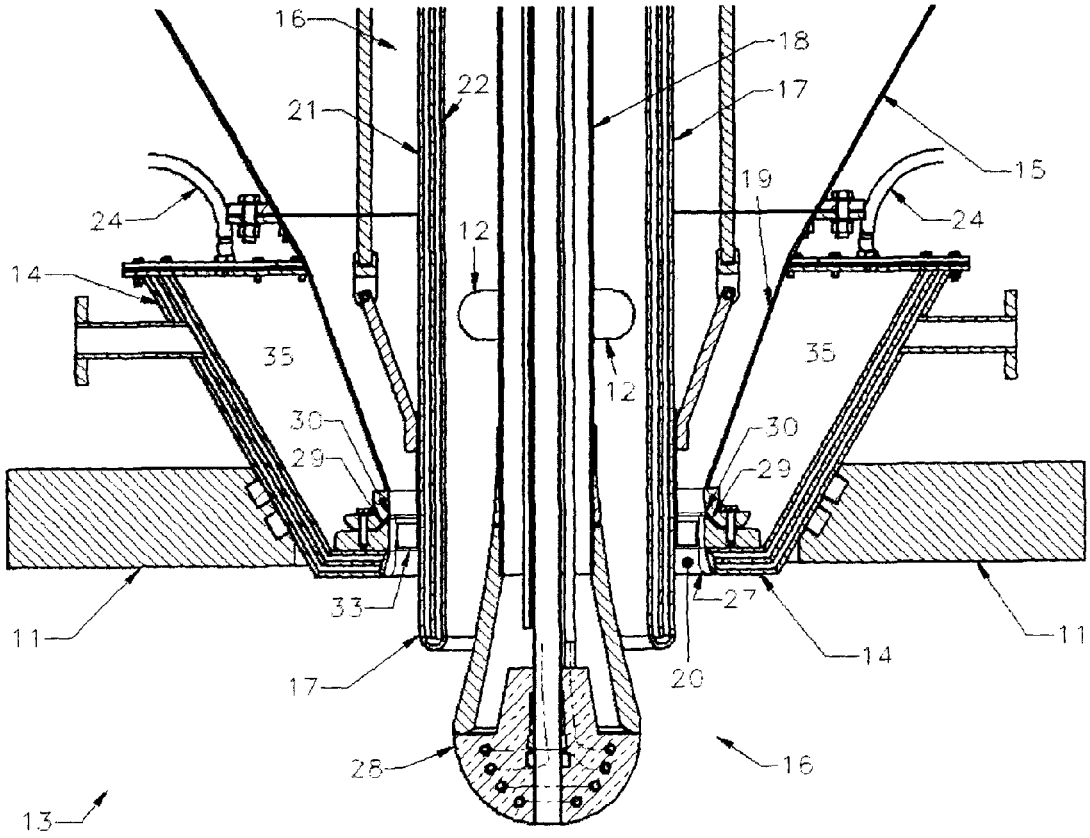
FIG. 7 is a cross-sectional view of a burner for a flash smelting furnace according to a sixth embodiment.

Turning to FIG. 7, a further embodiment is shown. Similar components are given like names and like reference numbers, and their description will not be repeated.

Figure 8:
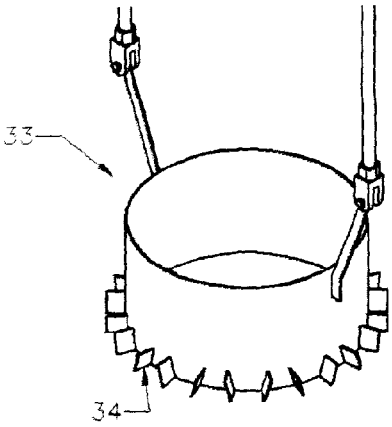
FIG. 8 is an isometric view of a turbulence generating component to be used with the burner embodiment of FIG. 7.

In this embodiment, a turbulence generating component 33 resides in the annular channel 20 defined by the opening 19 of the nozzle 14 and the sleeve 17, and manipulates the passing reaction gas flow profile. The turbulence generating component 33, as shown in FIG. 8, contains a plurality of wings 34, which are situated in pairs around the full circumference of the turbulence generating component 33 and fixed at an angle normal to the curved surface of the ring. Each pair of wings has an angle of attack with respect to the direction of the fluid flow. The angle of attack and wing spacing is selected to produce the desired turbulence structure generated by the turbulence generating component 33.

As the fluid from the wind box 15 passes each pair of wings 34, counter-rotating eddies are formed through the annular channel 20 defined by the opening 19 of the nozzle 14 and the sleeve 17, thereby increasing the turbulence of the reaction gas entering the reaction shaft, increasing the degree of mixing of the reaction gas and feed thereby promoting better combustion.

The vertical position of the turbulence generating component 33 can be controlled to provide the optimal degree of turbulent mixing required depending on the incoming reaction gas flow rate and composition.

The vertical position of the turbulence generating component 33, hence the turbulence intensity of the reaction gas, is controlled independently of the axial velocity of the reaction gas, which is controlled by the pressurized plenum 35 fluid velocity.

It will be appreciated by those skilled in the art that many variations are possible within the scope of the claimed subject matter. The embodiments that have been described above are intended to be illustrative and not defining or limiting. For example, the streams of fluids expelled into the reaction gas through each port can be individually controlled, or they can be controlled in groups or clusters, for example radiating from common headers. The ports themselves may be in the form of simple holes, or slits, continuous or non-continuous around the circumference, or may be in the form of jets. The discharge direction and velocity could also be adjusted, mechanically or by other means. In some cases, pulsing of the fluid streams may be employed.

Computational Fluid Dynamic (CFD) analysis was used to investigate a benchmark reaction shaft and burner to understand the effects of swirl intensity and turbulence intensity within a smelting furnace. The results, as shown in Table 2, indicate that increased swirl intensity and turbulence intensity within the reaction shaft can lead to improved combustion.

TABLE 2

| | Oxygen Efficiency [%] |
|---|---|
| Baseline Case, No Swirl | 92.7 |
| Baseline Case, Swirl Number = 1.5 | 94.5 |
| Baseline Case, No Turbulence | 92.5 |
| Baseline Case, Turbulence Intensity = 15% | 93.6 |

Moreover, in some examples, ports for directing the fluidic control gas stream may be located in the wind box interior or proximal to its outer shell.

In some cases, the stream of fluid may be fed by redirected reaction gas. In other cases, the conduits may communicate with pressurized air, oxygen, nitrogen, or oxygen enriched air, or another suitable fluid. Where it is desired to draw in a stream of fluid from the reaction gas, the conduits can communicate with a source of reduced pressure.

In some cases, turbulence generating components may fitted with sheets of a helical geometry, or other insert geometries, in lieu of the angled wings, to provide alternative gas flow patterns and mixing characteristics within the reaction shaft.

While the above subject matter has been described in the context of burners for flash smelting furnaces, it will be appreciated that it may also have application to other burner for pulverous feed materials, such as burners for furnaces that are fueled by pulverous coal.

What is claimed is:

1. A burner for use on a flash smelting furnace having a roof and a reaction shaft, the burner comprising:

a burner structure that integrates with the roof of the furnace, having a nozzle that defines an opening therethrough to communicate with the reaction shaft of the furnace;

a gas supply channel to supply reaction gas to the reaction shaft through the nozzle;

a feed supply for delivering pulverous material;

an injector having a sleeve for delivering the pulverous material into the furnace, the injector extending through the nozzle, defining therewith an annular channel through which the reaction gas flows into the reaction shaft, with the reaction gas flow having at least one boundary layer within the annular channel;

a fluidic control system having at least one port to direct a stream of fluidic control regulating fluid at an angle to the direction of flow of the reaction gas through the annular channel;

wherein the stream of fluidic control regulating fluid is used to manipulate the at least one boundary layer and thereby adjust the cross-sectional area of the reaction gas flow within the annular channel so as to alter the exit velocity of the reaction gas flow into the reaction shaft.

2. The burner of claim 1, further comprising:

a burner block that integrates with the roof of the furnace, the block having an opening therethrough to communicate with the reaction shaft of the furnace;

a wind box to supply reaction gas to the reaction shaft through a nozzle in the block opening, the wind box being mounted over the block;

the injector having a central lance within the sleeve to supply compressed air for dispersing the pulverous material in the reaction shaft, the injector mounting within the wind box so as to extend through the nozzle, defining therewith the annular channel through which reaction gas from the wind box flows into the reaction shaft.

3. The burner of claim 1 wherein the at least one port is connected to at least one conduit that carries the stream of fluid remote from the at least one port.

4. The burner of claim 1 wherein the at least one port can expel the stream of fluid into the reaction gas.

5. The burner of claim 1 wherein the at least one port communicates with a source of reduced pressure so as to create a partial vacuum that decreases the boundary layer and thereby decreases the exit velocity of the reaction gas into the reaction shaft.

6. A burner according to claim 1 further comprising at least one valve to adjust the stream of fluid.

7. The burner of claim 6 further comprising an actuator to control the at least one valve.

8. A burner according to claim 1 wherein the at least one port is a plurality of ports.

9. A burner according to claim 1 wherein the at least one port includes at least one port located on the sleeve.

10. The burner of claim 3 wherein the conduit passes within the wall of the sleeve.

11. A burner according to claim 1 wherein the at last one port includes at least one port located on the nozzle.

12. A burner according to claim 1 wherein the at last one port includes at least one port located within the wind box, above the annular channel.

13. A burner according to claim 1 wherein the stream of fluid manipulates the boundary layer to alter the exit velocity of the flow of the reaction gas into the reaction shaft.

14. A burner according to claim 1 further comprising a swirl inducing component having guide vanes revolved around the nozzle to induce swirling of the flow of the reaction gas independently of the port fluid streams.

15. A burner according to claim 14 wherein the swirl inducing component can be moved vertically by means internal or external to the wind box.

16. A burner according to claim 1 further comprising a turbulence generating component having a plurality of wings around the nozzle to induce turbulence of the flow of the reaction gas independently of the port fluid streams.

17. A burner according to claim 1 further comprising a turbulence generating component having a plurality of helical vanes around the nozzle to induce turbulence of the flow of the reaction gas independently of the port fluid streams.

18. The burner of claim 1 wherein the nozzle interior forms a cavity that is supplied with one or more fluid streams to supply one or more ports located within the nozzle.

19. A burner according to claim 1 wherein the stream of fluid includes a component that is directed at a tangential angle to the direction of flow of the reaction gas to induce a swirling motion to the flow of the reaction gas.

* * * * *